US005448977A

United States Patent [19]

Smith et al.

[11] Patent Number: 5,448,977

[45] Date of Patent: Sep. 12, 1995

[54] FUEL INJECTOR PULSEWIDTH COMPENSATION FOR VARIATIONS IN INJECTION PRESSURE AND TEMPERATURE

[75] Inventors: James C. Smith, Farmington Hills; Robert S. Mihora, Detroit, both of Mich.

[73] Assignee: Ford Motor Company, Dearborn, Mich.

[21] Appl. No.: 168,287

[22] Filed: Dec. 17, 1993

[51] Int. Cl.[6] ..... F02M 51/00

[52] U.S. Cl. ..... 123/478; 123/480

[58] Field of Search ..... 123/478, 480, 486, 494, 123/458, 497

[56] References Cited

U.S. PATENT DOCUMENTS

| | | | |
|---|---|---|---|
| 4,235,205 | 11/1980 | Fukui et al. | 123/472 |
| 4,357,923 | 11/1982 | Hideg | 123/492 |
| 4,418,673 | 12/1983 | Tominari et al. | 123/478 |
| 4,430,978 | 2/1984 | Lewis et al. | 123/478 |
| 4,462,365 | 7/1984 | Uozumi | 123/480 |
| 4,522,177 | 6/1985 | Kawai et al. | 123/478 |
| 4,681,076 | 7/1987 | Müller | 123/478 |
| 4,699,109 | 10/1987 | Hensel | 123/478 |
| 5,237,975 | 8/1993 | Betki et al. | 123/497 |
| 5,313,924 | 5/1994 | Regueiro | 123/458 |

*Primary Examiner*—Thomas N. Moulis

*Attorney, Agent, or Firm*—Peter Abolins; Roger L. May

[57] ABSTRACT

An internal combustion engine fuel injector pulsewidth is calculated as a function of desired fuel mass and injector pressure. Accounting for variations in injection pressures provides improved accuracy of fuel mass injection.

2 Claims, 3 Drawing Sheets

FUEL INJECTOR PULSEWIDTH COMPENSATION FOR VARIATIONS IN INJECTION PRESSURE AND TEMPERATURE

BACKGROUND OF THE INVENTION

1. Field of the Invention

This invention relates to electronic controls for an internal combustion engine.

2. Prior Art

In known production implementations, fuel delivery systems have typically used a mechanical fuel pressure regulator to control to a nominal fuel injection pressure. Fuel not ingested by the engine was returned to the fuel tank (see FIG. 1). With this type of fueling system, the instantaneous pressure across the fuel injectors ($\Delta p_{inj}$) was not known exactly, nor was it adjustable during operation. Therefore, fueling calculation done in an electronic engine control may have used a fixed nominal curve relating the desired fuel to be injected ($m_{inj}$) to a corresponding injection pulsewidth ($PW_{inj}$) that tells the time the injector is to be commanded open. An example of this type of piece-wise linear fuel injector flow curve is shown in FIG. 2, at a fixed injection pressure.

Current production often modifies fuel injector pulsewidths, but strictly as a function of the desired fuel mass to be injected. There are also Hot Injector COMPensation (HICOMP) strategies, but these are ad hoc and may not use a fuel rail temperature sensor. Neither of these account or allow for varying injection pressures.

SUMMARY OF THE INVENTION

With the advent of returnless fuel delivery systems (no fuel returned to the tank), a sensor to measure $\Delta P_{inj}$ was needed to help replace the function of the mechanical pressure regulator (see FIG. 3). Furthermore, a sensor to measure the temperature of the fuel within the fuel rail ($T_{fr}$) was needed since $\Delta P_{inj}$ is commanded to be higher with temperature to minimize fuel vaporization in the rail. Beyond simply using the information provided by the pressure sensor to help maintain $\Delta p_{inj}$ to a desired value, it may be used to modify the calculation of the $PW_{inj}$ for the following two reasons. First, since maintaining the exact pressure in a returnless fuel delivery system with a pump controller is not possible, transient pressure errors may be accounted for by using the actual $\Delta p_{inj}$ in the $PW_{inj}$ calculation. Second, since the $\Delta p_{inj}$ desired across the injectors may not be constant, fuel metering accuracy may still be maintained using the same idea; account for the actual $\Delta_{inj}$ in the $PW_{inj}$ calculation.

The invention includes a method to adjust injector pulsewidth, $PW_{inj}$, to account for the instantaneous $\Delta p_{inj}$, in order to maximize fuel metering accuracy. This $\Delta p_{inj}$ can be measured using a differential pressure sensor mounted between the fuel rail and the intake manifold. This method can also account for the temperature of the fuel injector body which may be approximated as $T_{fr}$. As $T_{fr}$ and injector tip temperatures vary, so do the flow characteristics of the injectors. Thus, in accordance with an embodiment of this invention, internal combustion engine fuel injector pulsewidths, to deliver the desired fuel mass, are calculated as a function of injector pressure. Fuel rail temperature may also be used. The purpose is to keep fuel injection flows accurate regardless of variations in injection pressure and/or fuel injection temperature. Thus, this invention provides more accurate fuel metering.

Use of this invention provides additional control in providing the desired amount of fuel into the engine. Not only is the fuel pump controller attempting to control $\Delta p_{inj}$ to the desired value, any transient pressure errors are compensated for by the invention in the calculation of the $PW_{inj}$.

Further, in certain applications, it may be desirable to change the $\Delta p_{inj}$ during operation to optimize injection characteristics (variable pressure injection) and the method of this invention facilitates this. In order to execute a variable pressure injection scheme accurately, the injector flow curves must change to account for the desired $\Delta p_{inj}$ operating point being changed. So, the same algorithm (the invention) used to account for modest transient pressure variations (typically unintended variations around the nominal $\Delta p_{inj}$) can also be used for large, intended, long lasting pressure variations.

DETAILED DESCRIPTION OF THE INVENTION

Figure 1:
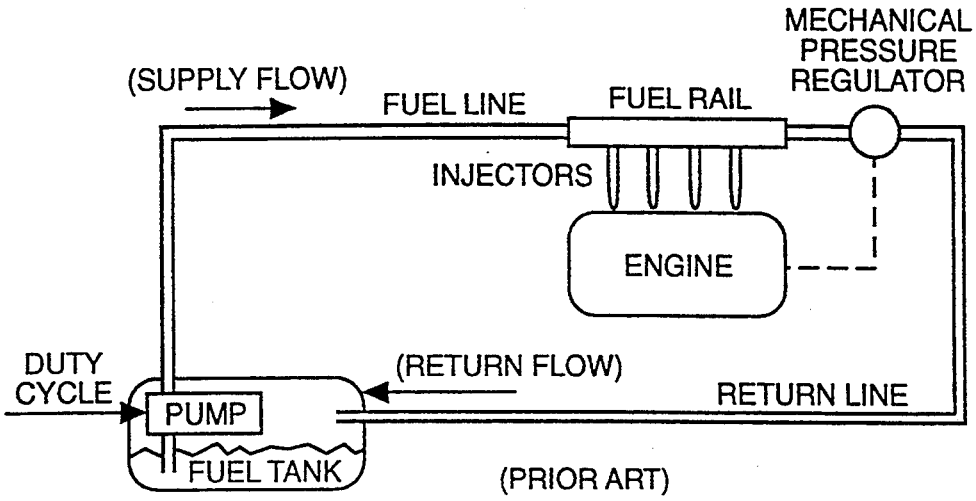
FIG. 1 is a block diagram of a fuel delivery system using a mechanical pressure regulator and a return line to the fuel tank in accordance with the prior art.
Figure 2:
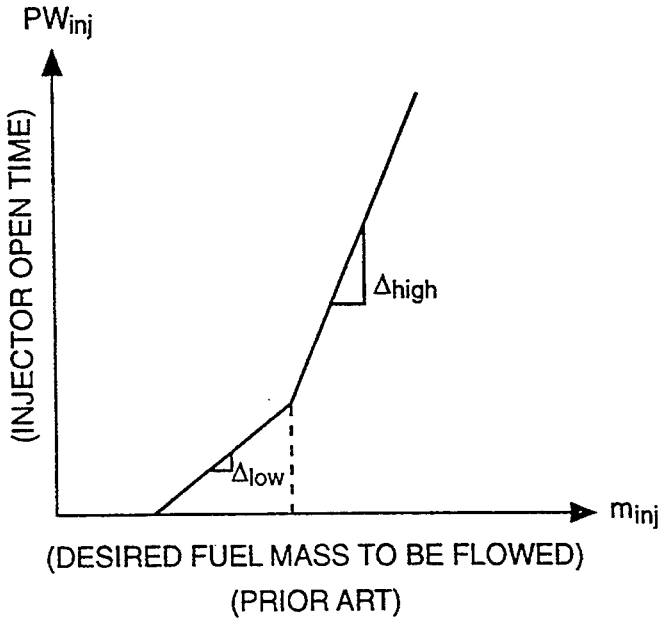
FIG. 2 is a graphical representation of the injector open time versus desired fuel mass to be flowed in accordance with the prior art.
Figure 3:
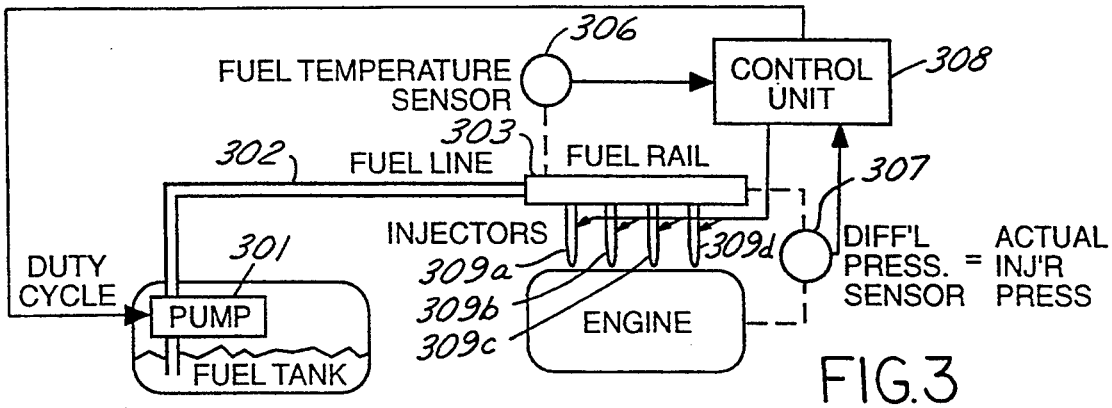
FIG. 3 is a schematic of a fuel delivery system without any return flow to the fuel tank in accordance with an embodiment of this invention.

Referring to FIG. 3, a fuel tank 300 includes a fuel pump 301 to pump fuel from fuel tank 300 through a fuel line 302 to a fuel rail 303. Injectors 304A, 304B, 304C, and 304D are coupled to fuel rail 303 and provide for injection of fuel into an engine 305. A fuel temperature sensor 306 is coupled to fuel rail 303. A differential pressure sensor 307 is coupled between fuel rail 303 and engine 305. Differential pressure sensor 307 measures the actual injector pressure by looking at the pressure across the injector. A control unit 308 receives input signals from fuel temperature sensor 306 and differential pressure sensor 307 and provides output signals to fuel injectors 304A, 304B, 304C, 304D to control fuel pulsewidth and to pump 301 to control pump duty cycle and fuel pressure. Control unit 308 is typically a microprocessor with stored processing information as further discussed below.

Figure 4:
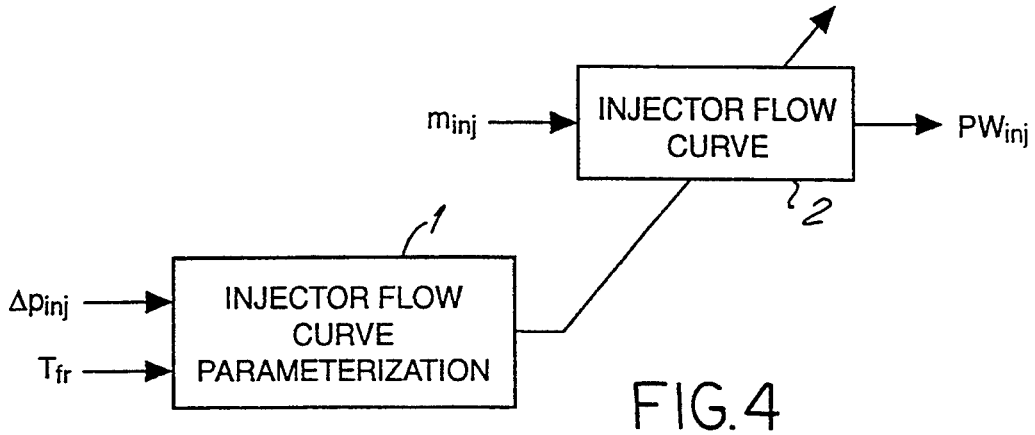
FIG. 4 is a block diagram wherein the fuel injector flow curve is a function of the instantaneous injection pressure and the fuel rail temperature, in accordance with an embodiment of this invention.

The invention may be represented by the block diagram in FIG. 4. First, in Block 1, the characteristics of the injector's flow curve are kept as a function of $\Delta p_{inj}$ and $T_{fr}$. The output of Block 1 (the flow curve characteristics) modify Block 2. Block 2 is the relationship which tells what $PW_{inj}$ is required to meter out a desired $m_{inj}$.

Figure 5:
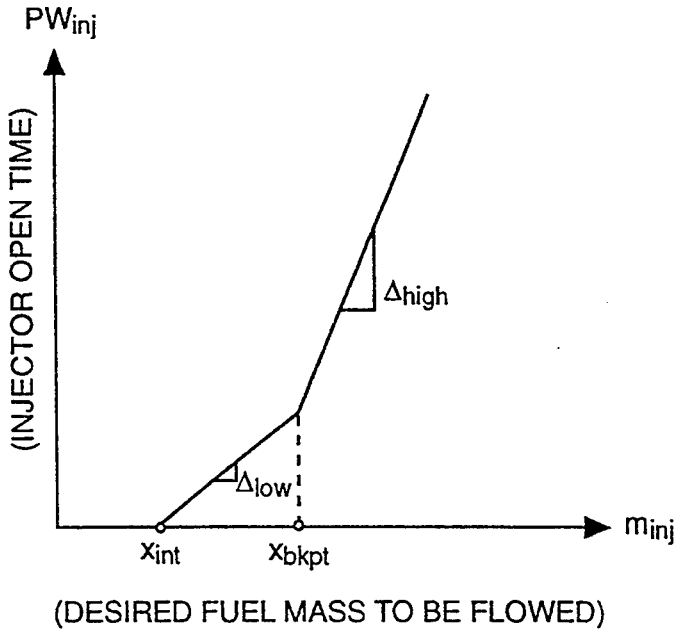
FIG. 5 is a fuel injector flow curve of injector open time versus the desired fuel mass to be flowed in accordance with an embodiment of this invention.
Figure 6:
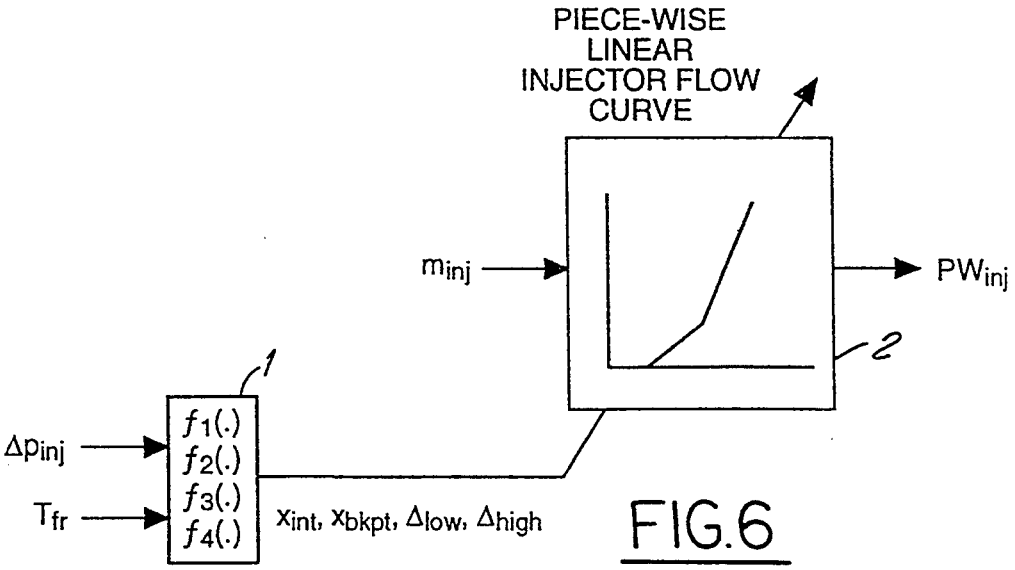
FIG. 6 is a block diagram implementing the curve of FIG. 5 using the block diagram of FIG. 4 in accordance with an embodiment of this invention.

One possible implementation of the invention of FIG. 4 may be seen in FIGS. 5 and 6. Block 2 of FIG. 6, the flow relationship of the fuel injector, is a piece-wise linear curve shown in more detail in FIG. 5. This curve may be completely described by four terms of parameters: The x-axis intercept ($X_{int}$), the breakpoint ($X_{bkpt}$), the slope along the lower portion ($\Delta_{low}$), and the slope along the higher portion ($\Delta_{high}$). Block 1 of FIG. 4 becomes four relationship ($f_1$, $f_2$, $f_3$ and, $f_4$) that determine the four fuel-injector curve parameters given $\Delta p_{inj}$ and $T_{fr}$.

Figure 7:
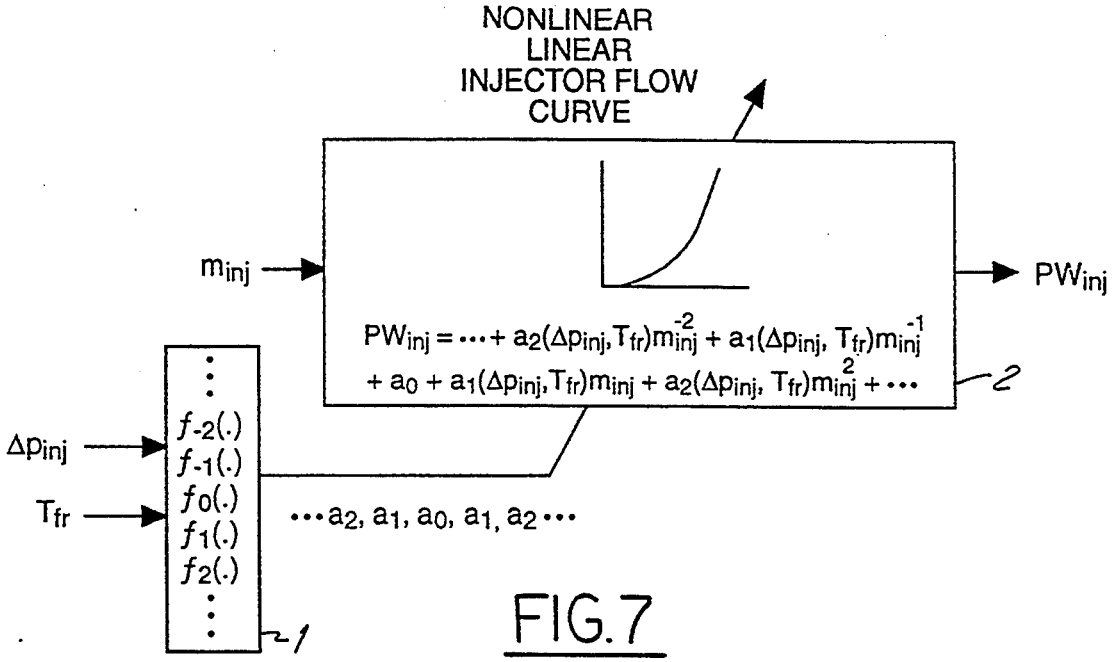
FIG. 7 is a block diagram of an implementation using algebraic parameterization or equation put in the form of the block diagram shown in FIG. 4 in accordance with an embodiment of this invention.

A second possible implementation of the invention, shown in FIG. 4, can be seen in FIG. 7. Here Block 2 of FIG. 7 would be a smooth curve (no discontinuities as with the piece-wise linear curve). This is a more accurate representation of injector operation than the piece-wise linear embodiment. The curve again relates $PW_{inj}$ to the desired $m_{inj}$ to be metered. This curve may be an algebraic parameterization of an equation, such as that in Eq. 1, where the coefficients are functions of $\Delta p_{inj}$ and $T_{fr}$.

$$PW_{inj}=\ldots +a_{-2}(\Delta p_{inj},T_{fr})m_{inj}^{-2}+a_{-1}(\Delta p_{inj},T_{fr})m_{inj}^{-1}+a_0=a_1(\Delta p_{inj},T_{fr})m_{inj}+a_2(\Delta p_{inj},T_{fr})m_{inj}^{2}+ \quad \text{(Eq. 1)}$$

Block 1 of FIG. 7 has as inputs $\Delta p_{inj}$ and $T_{fr}$, and as outputs the "a" coefficients to define the flow relationship in Block 2 mapping the desired $m_{inj}$ to the $PW_{inj}$ that should be commanded. The function f of Block 1 in FIG. 7 are preselected fixed functions.

For any given pair of $\Delta p_{inj}$ and $T_{fr}$ values, the "a" coefficients will be fixed, yielding a smooth non linear mathematical relationship between $m_{inj}$ and $PW_{inj}$. But when $\Delta p_{inj}$ and $T_{fr}$ move to different values, so does the set of "a" coefficients.

By running various fuel flow bench tests on a given fuel injector, several sets of "a" coefficient values may be determined by regressing the data for each $\Delta p_{inj}$, $T_{fr}$ pair. The regression would yield the set of "a" coefficients whose resulting curve best matched the curve in the actual flow bench data.

With the various sets of requested "a" coefficients in hand, each coefficient itself may be regressed as a function of $\Delta p_{inj}$ and $T_{fr}$. This results in the functions shown in Block 1 of FIG. 7.

Many other implementations of this invention are possible, but they all adjust the $PW_{inj}$ not only as a function of desired mini, but also a function of injector pressure. Further, if desired, fuel injector temperature may also be used to compensate $PW_{inj}$.

Various modifications and variations will no doubt occur to those skilled in the art to which this invention pertains. Such variations which basically rely on the teachings through which this disclosure has advanced the art are properly considered within the scope of this invention.

We claim:

1. A method for compensating fuel injector pulsewidth in an internal combustion engine, including the steps of:

adjusting the fuel injector pulsewidth as a function of measured differential fuel injector pressure; and adjusting the fuel injector pulsewidth as a function of desired fuel mass to be injected; wherein the injector pulsewidth is related to the desired mass to be injected by a piece-wise linear curve including the steps of:

establishing an x intercept of a piece-wise linear curve as being a first function of the injector pressure and the fuel rail temperature;

establishing an x break point value of the piece-wise linear curve at the desired fuel mass as a second function of injector pressure and fuel rail temperature;

establishing a slope of the piece-wise linear curve between the x intercept and the break point as a third function of injector pressure and fuel rail temperature;

establishing the slope of the piece-wise curve for values of x greater than the x break point as a fourth function of injector pressure and the fuel rail temperature; and controlling the fuel injector to supply fuel to the combustion chamber of the associated internal combustion engine with the adjusted pulsewidth.

2. A method for compensating fuel injector pulsewidth in an internal combustion engine, including the steps of:

adjusting the fuel injector pulsewidth as a function of measured differential fuel injector pressure;

adjusting the fuel injector pulsewidth as a function of desired fuel mass to be injected; wherein the engine fuel injector pulsewidth is an algebraic parameterization of an equation relating $m_{inj}$ to $PW_{inj}$, wherein $m_{inj}$ is the desired fuel mass to be injected and $PW_{inj}$ is the fuel injector pulsewidth; wherein the algebraic parameterization uses coefficients which are a function of the fuel injector pressure and the fuel rail temperature in the following form:

$$PW_{inj}=\ldots +a_{-2}(\Delta p_{inj},T_{fr})m_{inj}^{-2}+a_{-1}(\Delta p_{inj},T_{fr})m_{inj}^{-1}+a_0+a_1(\Delta p_{inj},T_{fr})m_{inj}+a_2(\Delta p_{inj},T_{fr})m_{inj}^{2}+,$$

wherein $\Delta p_{inj}$ is fuel injector pressure and $T_{fr}$ is fuel rail temperature; and controlling the fuel injector to supply fuel to the combustion cheer of the associated internal combustion engine with the adjusted pulsewidth.

* * * * *